US007673942B2

(12) United States Patent
Tuckey et al.

(10) Patent No.: US 7,673,942 B2
(45) Date of Patent: Mar. 9, 2010

(54) HIGH CHAIR WITH SWIVEL FEATURE AND HEIGHT ADJUSTMENT

(75) Inventors: Peter R. Tuckey, Morgantown, PA (US); Adam D. Bearup, Shillington, PA (US); Joseph F. Fiore, Jr., Lebanon, PA (US)

(73) Assignee: Wonderland Nurserygoods Co., Ltd., Taipei (TW)

( * ) Notice: Subject to any disclaimer, the term of this patent is extended or adjusted under 35 U.S.C. 154(b) by 0 days.

(21) Appl. No.: 12/175,900

(22) Filed: Jul. 18, 2008

(65) Prior Publication Data

US 2009/0039692 A1 Feb. 12, 2009

Related U.S. Application Data

(60) Provisional application No. 60/964,336, filed on Aug. 10, 2007.

(51) Int. Cl.
*A47C 3/18* (2006.01)

(52) U.S. Cl. ..... 297/344.22

(58) Field of Classification Search ..... 297/344.21, 297/344.22, 344.26; 248/425
See application file for complete search history.

(56) References Cited

U.S. PATENT DOCUMENTS

| | | | | |
|---|---|---|---|---|
| 2,845,990 | A * | 8/1958 | Hubert | 297/461 |
| 5,244,253 | A | 9/1993 | Hollington | 297/344.19 |
| 5,480,210 | A | 1/1996 | Lehenbauer | 297/137 |
| 5,482,354 | A | 1/1996 | Gryp | 297/344.22 |
| 5,733,006 | A | 3/1998 | Woods | 297/344.22 |
| 5,890,764 | A * | 4/1999 | Lee | 297/344.22 |
| 5,941,498 | A * | 8/1999 | Hoshihara et al. | 297/344.22 |
| 6,079,786 | A * | 6/2000 | Kirkland et al. | 297/344.24 |
| 6,109,686 | A | 8/2000 | Fox | 297/105 |
| 6,131,997 | A * | 10/2000 | Cao | 297/344.22 |
| 6,361,111 | B1 | 3/2002 | Bowers | 297/344.22 |
| 6,536,842 | B2 * | 3/2003 | Bowers et al. | 297/344.22 |
| 6,877,811 | B1 * | 4/2005 | Garelick | 297/344.22 |
| 7,032,966 | B2 | 4/2006 | Myers | 297/137 |
| 7,185,949 | B2 | 3/2007 | Finell | |
| 2003/0218370 | A1 | 11/2003 | Langham | 297/344.22 |

FOREIGN PATENT DOCUMENTS

| | | |
|---|---|---|
| GB | 2401097 | 3/2005 |

* cited by examiner

*Primary Examiner*—Peter R. Brown
(74) *Attorney, Agent, or Firm*—Miller Law Group, PLLC

(57) ABSTRACT

A high chair incorporates a swivel feature and a height adjustment feature that permits the seat member to be positioned to the convenience of the caregiver. The high chair includes an H-shaped base member having a vertical pedestal member that houses a gas cylinder that provides height adjustment for the seat member and that supports the seat member for rotational movement relative to the pedestal. The H-shaped base allows the high chair to be positioned close to the caregiver. A swivel lock includes an actuation lever that has handles positioned on opposing sides of the seat member for actuation from either side of the high chair. The pivoted actuation lever also includes a spring-loaded stop member that is engagable with a toothed gear plate affixed to the pedestal to secure the rotated position of the seat member by positioning the stop member between teeth on the gear plate.

20 Claims, 10 Drawing Sheets

Fig. 9
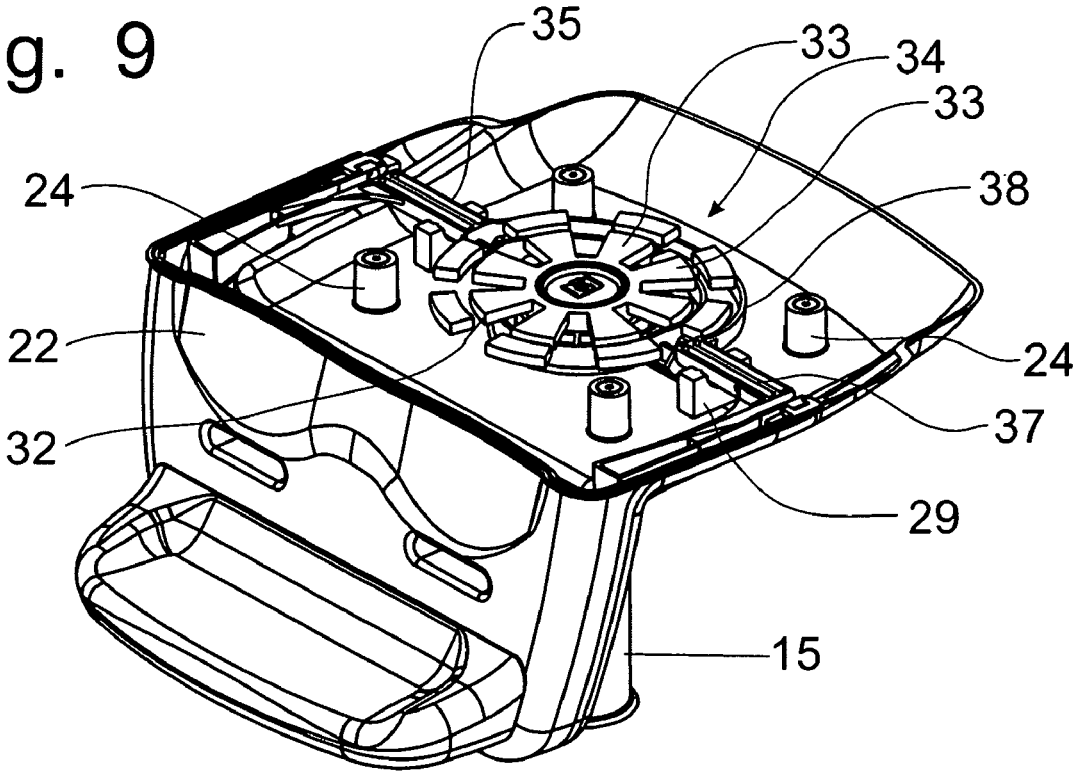
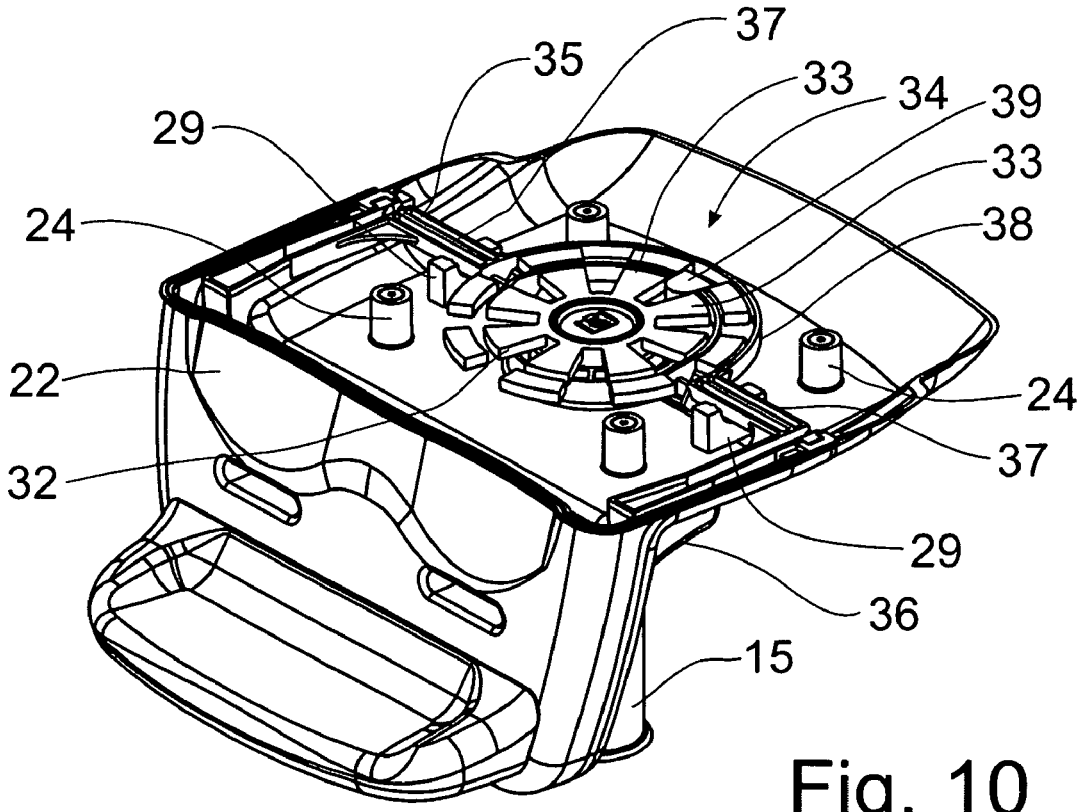
Fig. 10

HIGH CHAIR WITH SWIVEL FEATURE AND HEIGHT ADJUSTMENT

CROSS-REFERENCE TO RELATED APPLICATIONS

This application claims priority on U.S. Provisional Patent Application Ser. No. 60/964,336, filed on Aug. 10, 2007, the contents of which are incorporated herein by reference.

FIELD OF THE INVENTION

The present invention relates generally to a child's high chair and, more particularly, to a high chair configuration that incorporates a swivel feature for the child's seat.

BACKGROUND OF THE INVENTION

Different products are used by parents to aid in the positioning of their children to facilitate feeding them from the time the child is an infant until the child is old enough and large enough to sit at a table properly. One such product is a high chair, which is typically used to support infants and small toddlers at an elevated position so that the caregiver can easily feed the child. Another such product is a booster seat that is typically attached in a detachable manner to a standard chair so that the child is elevated on the chair to reach a normal table. Booster seats are typically used with older toddlers.

The high chair is a self-standing unit that provides a safe and secure seating area with a feeding tray that is removable from the high chair to facilitate the placement of the child on the high chair and to facilitate the cleaning of the tray and high chair structure. High chairs can incorporate height adjustment mechanism so that the seat can be vertically positioned to fit various table heights so that the tray mechanism could be removed from the high chair and the child positioned on the high chair be pushed up to a table. The booster seats typically attach to the standard chair with one or two adjustable straps so that the booster seat can be removed when no longer in use. The typical booster seat positions the child about three or four inches above the chair seat to locate the child at the table. Some booster seats are provided with height adjustment to fit various table heights. Some booster seats are adapted to receive a tray mechanism so that the booster seat can be utilized away from the table.

Although office chairs and other similar devices have long incorporated a swivel feature and/or a tilt feature combined with a height adjustment feature, child high chairs have traditionally been manufactured as a fixed structure with a base on which is mounted a fixed chair member for the seating of the child with the tray selectively positionable in front of the child. An example of an office chair having a chair tilt mechanism combined with a height adjustment feature can be found in U.S. Pat. No. 5,244,253, granted to Geoffrey Hollington, et al on Sep. 14, 1993, in which the rotatably mounted office chair incorporates a gas spring in a pedestal structure for the seat base with an actuation lever that is operable to release the gas spring to permit expansion thereof and a resulting vertical movement of the seat member.

The use of gas springs in a pedestal structure to provide a height adjustment feature is not limited to office furniture. In U.S. Pat. No. 7,185,949, granted to Rebecca Finell on Mar. 6, 2007, incorporates a wheeled base formed into an upwardly extending pedestal structure within which is supported a gas spring that is connected to the seat member. A vertical height adjustment of the seat member is accomplished through the manipulation of a foot pedal that releases the gas spring in a conventional manner to permit the vertical movement of the high chair seat. This high chair structure does not incorporate a swivel feature for the seat member as rotational movement of the high chair can be accomplished through a rotation of the wheeled base, which incorporates an arresting feature to limit the movement of the wheeled base structure.

Chairs or seats are known to incorporate a swivel feature. A swivel seat for use in a vehicle, such as a farm tractor or a combine, for example, is disclosed in U.S. Pat. No. 5,482,354, issued on Jan. 9, 1996, to Dennis Gryp in which the selected rotated position of the seat is controlled through a rack mechanism that is cooperable with an actuation lever to secure the position of the seat by engaging a notch in the toothed rack with the actuation lever. Similarly, the tractor seat in U.S. Pat. No. 5,733,006, issued to Perry Woods on Mar. 31, 1998, is positionally controlled by a stop pin engagable through aligned holes in the seat member and the base member, with the actuation mechanism being positionable in a free swivel mode of operation.

In U.S. Pat. No. 6,361,111, granted on Mar. 26, 2002, to Daniel Bowers, et al, the seat member of a powered personal mobility vehicle is pivotally mounted for movement through substantially a 180 degree range of movement to permit the operator to rotate the seat member ninety degrees from a central operating position for ease of ingress and egress to the seat member. This seat member incorporates a notched disk affixed to the base member. The actuation lever can be pivotally manipulated to selectively place a stop member into engagement with the notched disk to secure the seat member in the selected rotated position.

The high chair disclosed in U.S. Pat. No. 7,032,966, granted to Peter Myers on Apr. 25, 2006, includes a base stand that can incorporate a turn table mechanism that provides a rotational function for the high chair seat member. The turn table mechanism incorporates a series of notches around the circumference thereof. A spring-loaded latch mechanism is engagable with the notches around the circumference of the turn table mechanism to restrain the rotated position of the high chair seat member. As is seen in FIGS. 11-16 of the Myers patent, the turn table mechanism is a substantial structural part of the seat member that also incorporates a tilt function for the seat member.

It would be desirable to provide a high chair structure that will provide a swivel feature that can be actuated conveniently by the caregiver to position the high chair seat member at a desired rotated position relative to the base member, while incorporating a high adjustment feature for the seat member.

SUMMARY OF THE INVENTION

It is an object of this invention to provide a high chair that will incorporate a swivel feature combined with a high adjustment feature.

It is another object of this invention to provide a swivel lock mechanism for a child's high chair that will provide accessibility from either side of the high chair seat member.

It is a feature of this invention that the actuation lever extends from a pivot axis to both opposing sides of the high chair seat member to permit actuation from either side of the seat member.

It is an advantage of this invention that the actuation lever can be actuated from either side of the high chair seat member.

It is another advantage of this invention that the actuation lever provides the caregiver with a natural and logical movement by pulling up while rotating the seat member.

It is still another advantage of this invention that the placement of the actuation lever on opposing sides of the high chair seat member, underneath the seat member helps prevent unintentional unlocking of the swivel feature of the seat member.

It is another feature of this invention that the actuation lever incorporates a stop member that is engagable with a toothed gear plate affixed to the pedestal structure of the high chair.

It is still another feature of this invention that the height adjustment feature of the child high chair utilizes a gas spring supported within the pedestal structure.

It is yet another feature of this invention that the base member incorporates a foot pedal that is operatively connected to the gas spring to affect a release thereof.

It is an advantage of this invention that the gas spring can be easily manipulated through a foot pedal positioned on the high chair base.

It is another advantage of this invention that the pivot axis for the actuation lever of the swivel lock mechanism for the child high chair is centralized to permit the movement of the actuation handles to be translated into a pivotal movement of the stop member engagable with the toothed gear plate.

It is still another feature of this invention that the actuation lever is formed in a general U-shaped configuration to provide opposing actuation handles that can be actuated from either side of the seat member and a single stop member on the opposing side of a central pivot axis.

It is yet another feature of this invention that the actuation lever is spring-loaded into a locked position by a spring member disposed beneath the stop member.

It is still another advantage of this invention that the spring-loaded actuation lever prevents the seat member from becoming a free rotating structure.

It is still another object of this invention to provide a base member that can provide greater flexibility in locating the high chair adjacent tables and furniture on which the caregiver is seated.

It is a further feature of this invention that the base member of the child high chair is formed in an H-shaped configuration.

It is a further advantage of this invention that the H-shaped base member can be positioned relative to adjacent furniture legs that the H-shaped base member can slide past the furniture leg without obstruction.

It is still a further advantage of this invention that the caregiver can be seated closer to the child seated in the high chair seat member without being obstructed by the high chair base member.

It is still a further feature of this invention that the H-shaped base member incorporates a vertical pedestal structure incorporating the height adjustment feature for the high chair and supporting the seat member for rotation relative to the pedestal structure and the base member.

It is yet another object of this invention to provide a high chair structure incorporating a swivel function and a height adjustment function that is durable in construction, inexpensive of manufacture, carefree of maintenance, facile in assemblage, and simple and effective in use.

These and other objects, features and advantages are accomplished according to the instant invention by providing a high chair that incorporates a swivel feature and a height adjustment feature that permits the seat member to be positioned to the convenience of the caregiver. The high chair includes an H-shaped base member having a vertical pedestal member that houses a gas cylinder that provides height adjustment for the seat member and that supports the seat member for rotational movement relative to the pedestal. The H-shaped base allows the high chair to be positioned close to the caregiver. A swivel lock includes an actuation lever that has handles positioned on opposing sides of the seat member for actuation from either side of the high chair. The pivoted actuation lever also includes a spring-loaded stop member that is engagable with a toothed gear plate affixed to the pedestal to secure the rotated position of the seat member by positioning the stop member between teeth on the gear plate.

BRIEF DESCRIPTION OF THE DRAWINGS

The advantages of this invention will be apparent upon consideration of the following detailed disclosure of the invention, especially when taken in conjunction with the accompanying drawings wherein:

FIG. 9 is a front side perspective view of the swivel lock mechanism housed within the seat member, portions of the seat member and the base member being broken away for purposes of clarity, the actuation lever being pivoted into a release position to affect rotation of the seat member relative to the pedestal and base;

FIG. 10 is a front side perspective view similar to that of FIG. 9, but depicting the actuation lever being pivoted into the lock position to secure the seat member from rotation;

DETAILED DESCRIPTION OF THE PREFERRED EMBODIMENT

Figure 2:
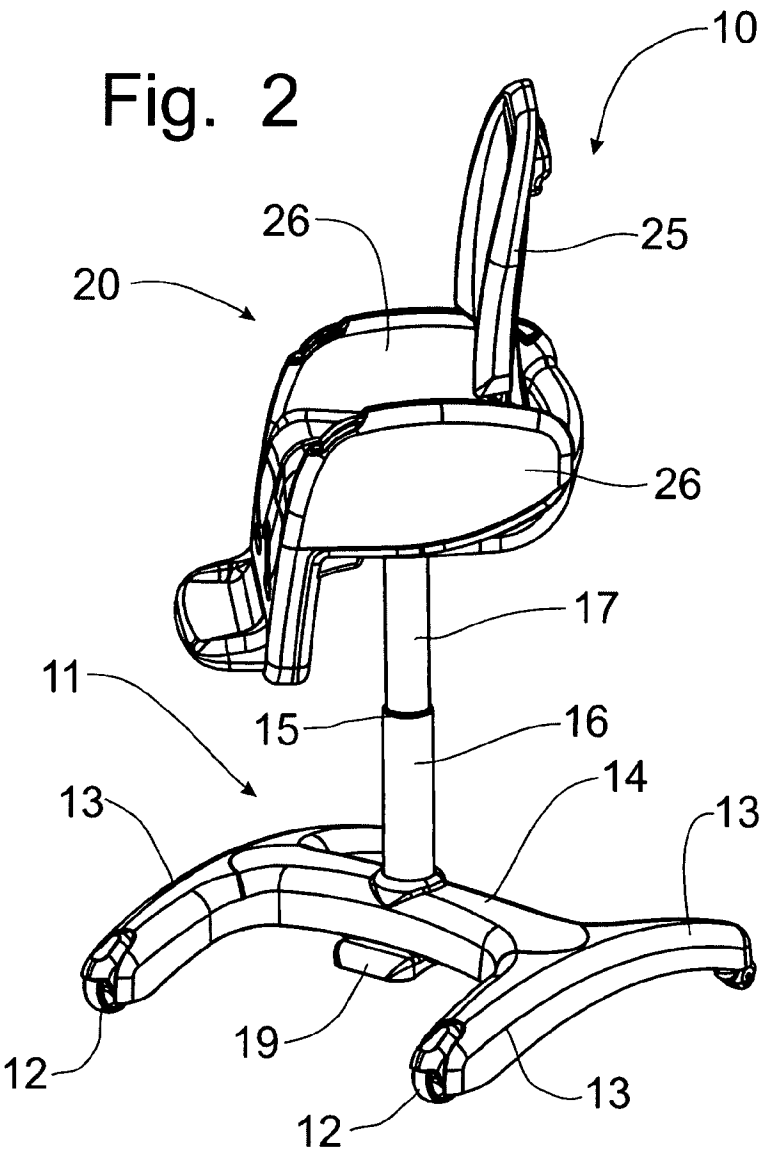
FIG. 2 is a side perspective view of the high chair depicted in FIG. 1.

Referring now to the drawings, a child high chair incorporating the principles of the instant invention can best be seen. The high chair 10 is constructed with a base member 11 having wheels 12 mounted thereon to make the base member mobile. At least two of the wheels 12 having conventional wheel locks 12*a* to restrict movement of the base member 11. The base member 11 is preferably formed in an H-shaped configuration with four legs 13 that are joined together at the central transverse member 14 so that the legs 13 project fore-and-aft from the ends of the transverse member 14. With the wheels 12 mounted at the distal ends of the legs 13, the base member is positionable over the surface of the floor such that a table leg, or chair leg can be oriented between the legs 13 to enable the high chair 10 to be moved very close to the obstructing furniture (not shown).

Projecting upwardly from the center of the transverse member 14 is a vertical pedestal member formed to have a fixed base portion 16 and a telescopic upper portion 17 interconnected by a gas spring 18 to control the telescopic movement of the upper portion 17 relative to the base portion 16. A foot pedal 19 is operatively connected to the gas spring 18 to control the release of the gas spring 18 in a conventional manner. Depressing the foot pedal 19 releases the gas spring 18 to allow the gas spring 18 to expand or contract if sufficient weight is asserted to collapse the gas spring 18. In this manner, height adjustment for the high chair 10 can be accomplished simply and conveniently.

Figure 1:
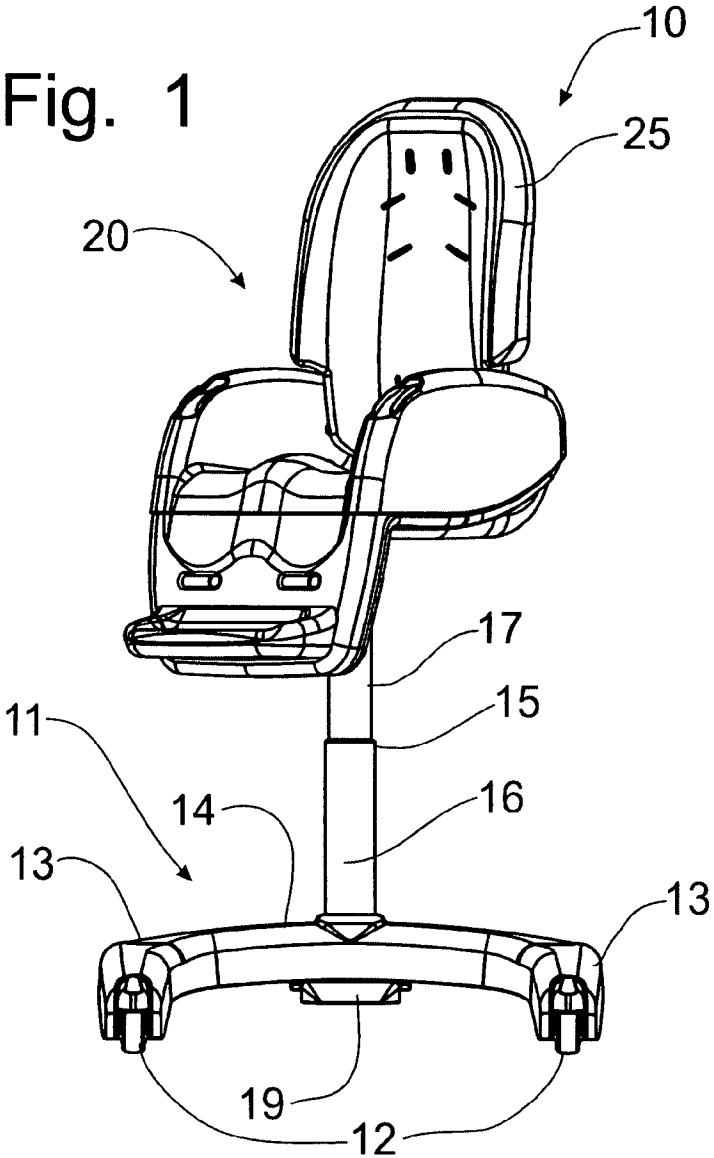
FIG. 1 is a front perspective view of a high chair incorporating the principles of the instant invention, the seat member being rotated to the right of a central position relative to the H-shaped base member.
Figure 4:
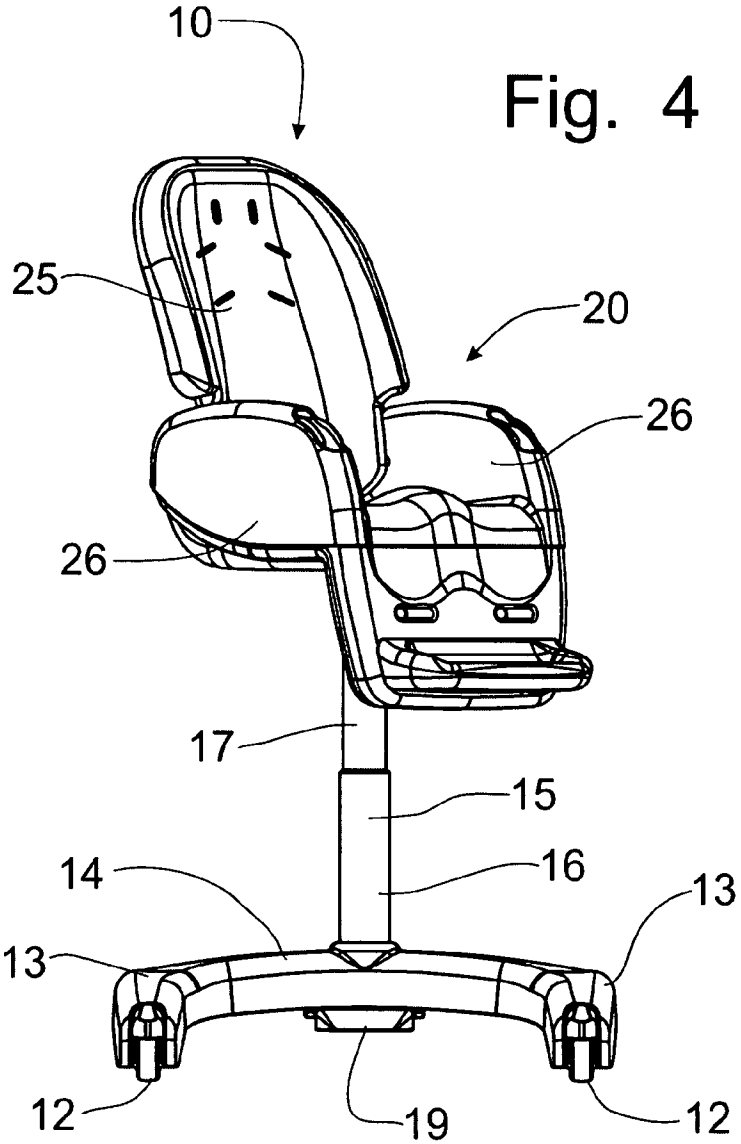
FIG. 4 is a front perspective view of a high chair similar to that of FIG. 1, but depicting the seat member as being rotated to the left of a central position relative to the H-shaped base member.
Figure 3:
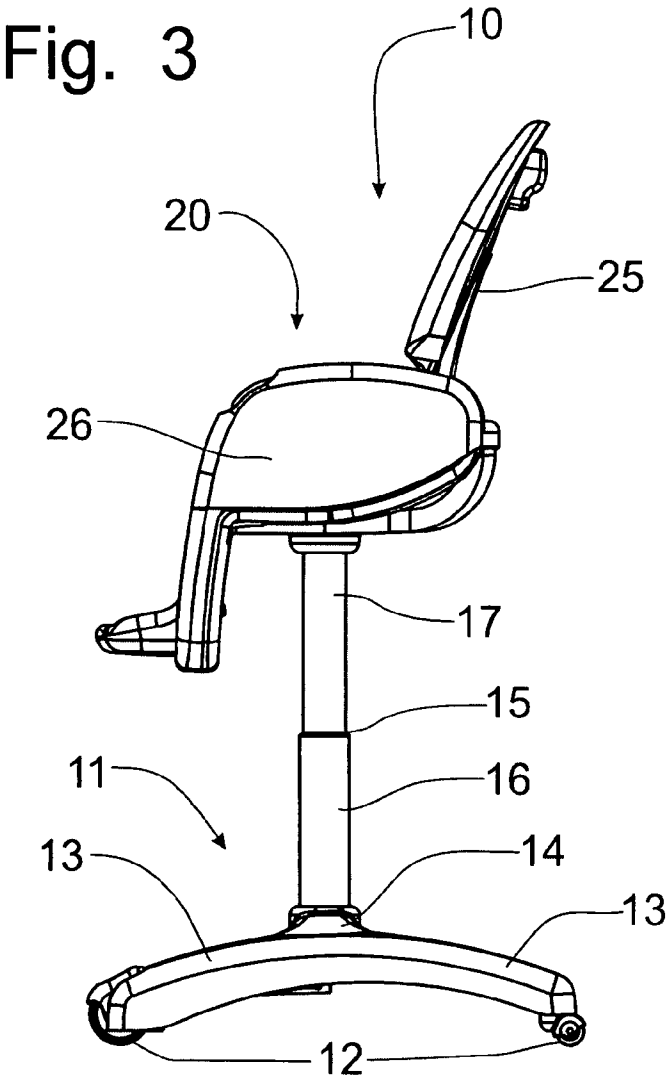
FIG. 3 is a side elevational view of the high chair shown in FIG. 1.
Figure 6:
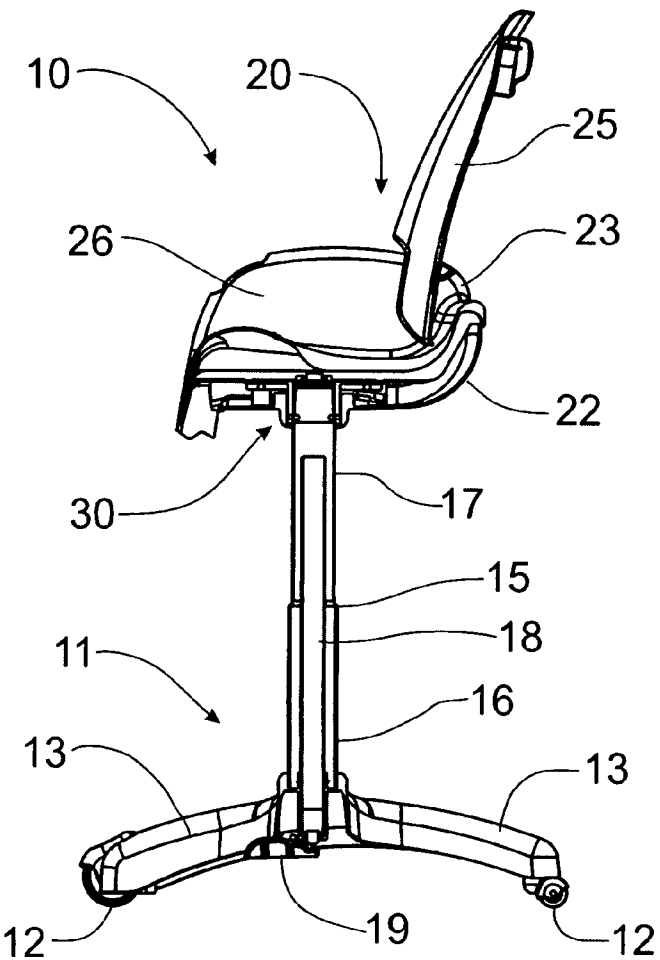
FIG. 6 is a vertical cross-sectional view of the high chair corresponding to lines 6-6 of FIG. 5.
Figure 5:
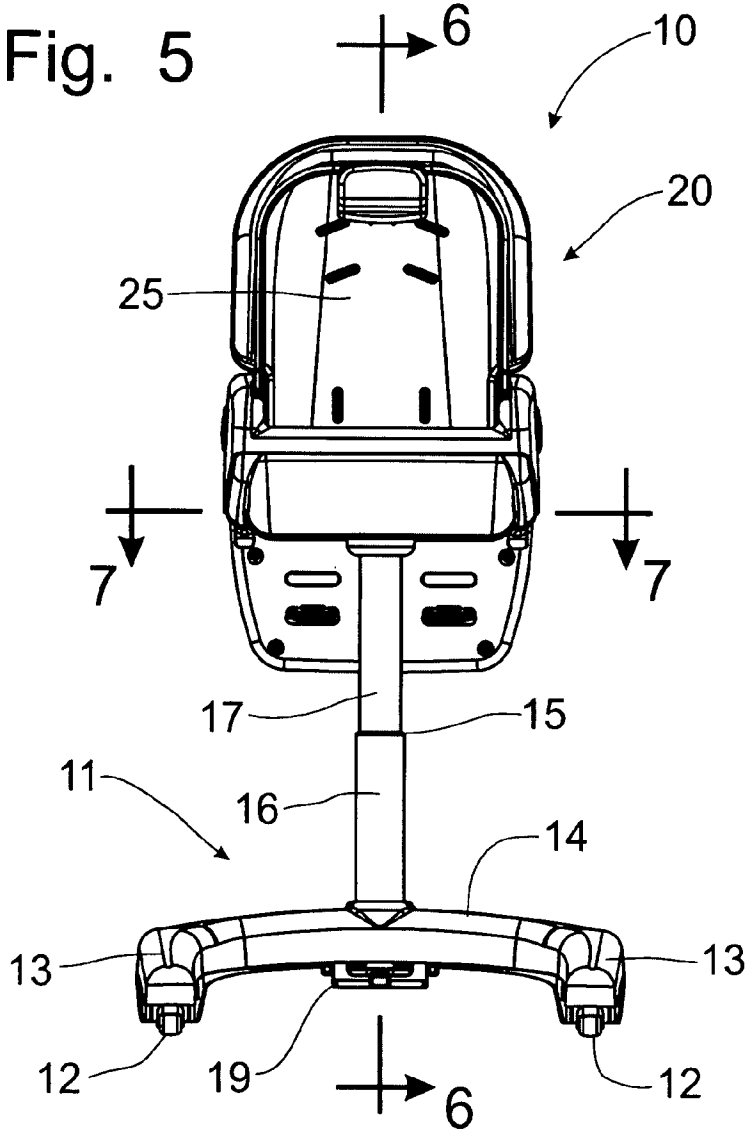
FIG. 5 is a front elevational view of the high chair placed in a central position relative to the H-shaped base member.
Figure 7:
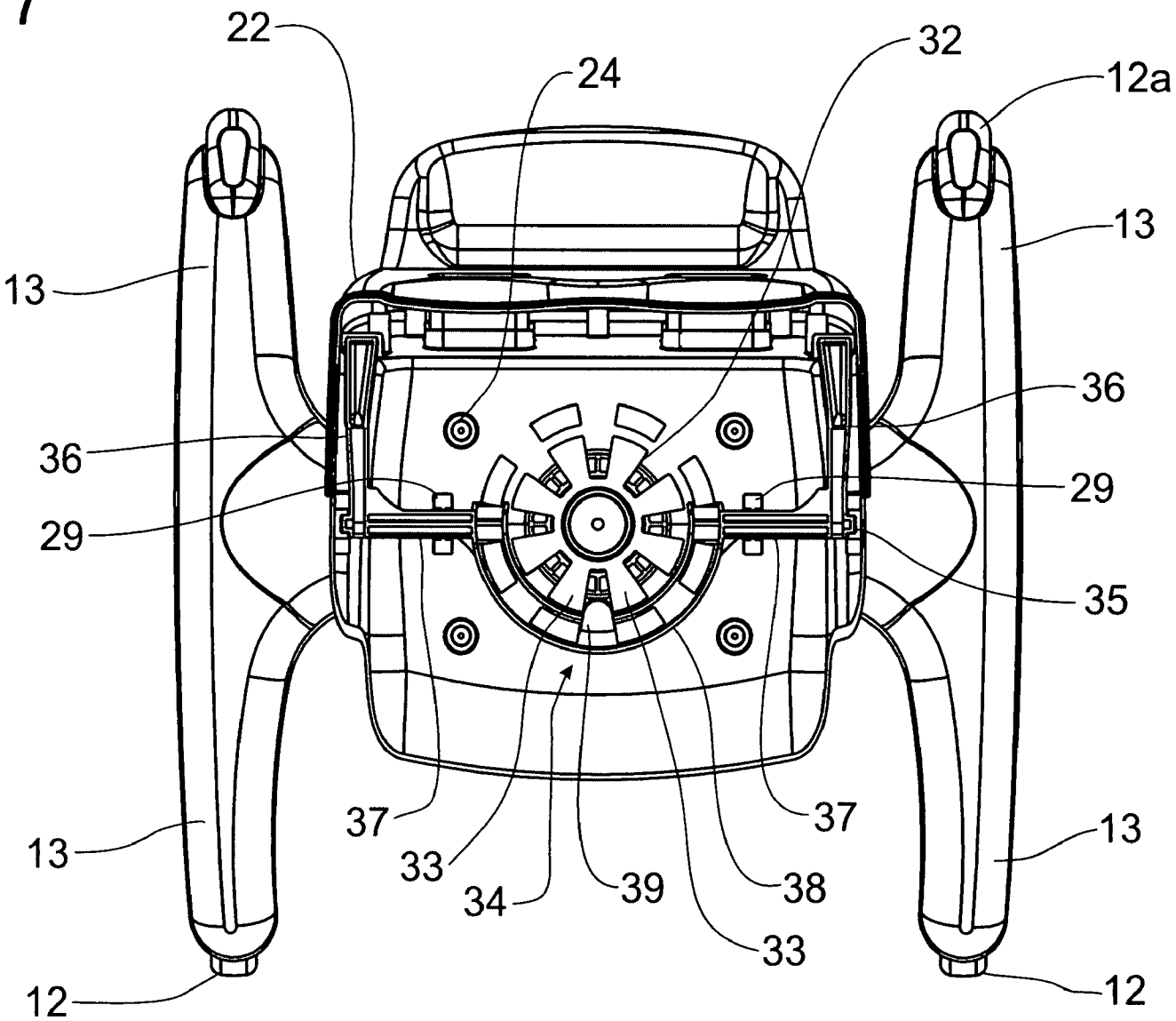
FIG. 7 is a horizontal cross-sectional view of the high chair taken along lines 7-7 of FIG. 5 to shown the swivel lock mechanism.
Figure 8:
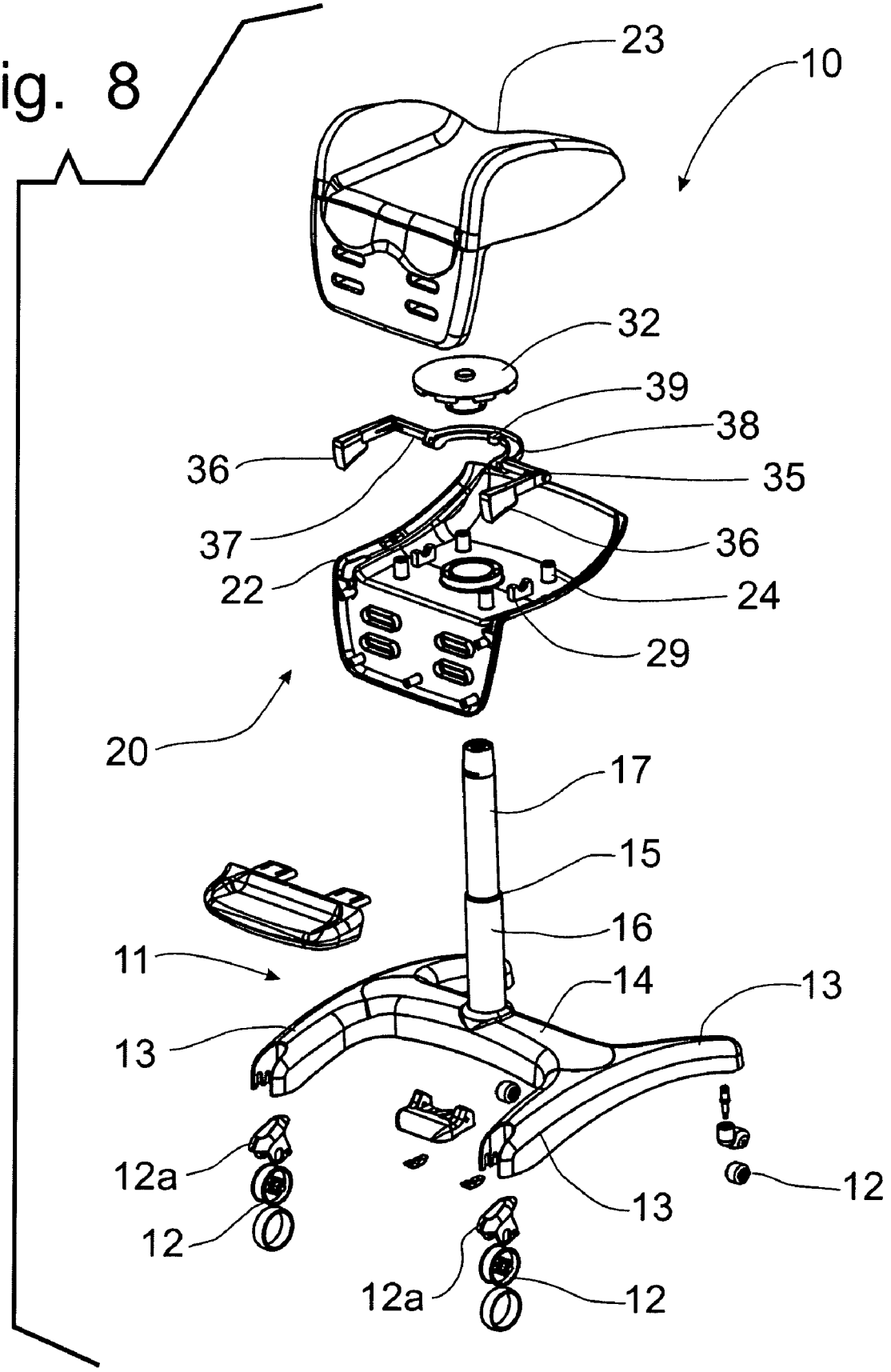
FIG. 8 is a perspective exploded view of the high chair incorporating the principles of the instant invention, the seat member being partially broken away for the purposes of clarity.

The seat member 20 is rotatably supported on the upper portion 17 of the pedestal 15 to provide a swivel function for the seat member 20 relative to the base member 11. As depicted in FIG. 1, the seat member 20 is rotatable to the right of a center position, shown in FIG. 5, and also to the left of the center position, as depicted in FIG. 4. The seat member 20 does not incorporate any stops that limit the range of rotation to either the right or left directions. The seat member is formed with a base portion 22 and a seat portion 23 that is mounted on the base portion 22 to form the seat member 20. The seat portion 23 is secured to the base portion 22 through fasteners inserted into bosses 24 formed on the base portion, as are best seen in FIG. 7. The seat portion 23 is formed with a seat back 25 to support a child seated on the seat portion 23. Arm rests 26 are preferably included on the seat portion 23 to control any lateral movement of the child on the seat portion 23. An alternative configuration of the seat member 20 can be found in co-pending U.S. patent application Ser. No. 12/145,310, filed on Jun. 24, 2008, the description of which, including the attachment of the tray and the seat back recline mechanism, being incorporated herein by reference.

As best seen in FIGS. 7-12, the base portion 23 includes a swivel lock mechanism 30 to restrict the rotational movement of the seat member 20 relative to the pedestal 15. The swivel lock mechanism 30 includes a stationary toothed gear plate 32 affixed to the pedestal 15 and an actuator member 35 pivotally supported on and carried with the base portion 22. The actuator member 35 is formed, generally, in a U-shaped configuration with a pair of actuator handles 36 located at the distal ends of the actuator member 35. The actuator member 35 is also formed with transversely extending pivot members 37 that are pivotally supported on the base portion 22 by the pivot supports 29. A generally arcuate lock member 38 extends rearwardly from the centrally located, transverse pivot members 37 and is oriented concentrically with said gear plate 32. The lock member 38 includes a stop member 39 sized to fit into the respective notched 34 formed between the teeth members 33 of the gear plate 32.

Figure 12:
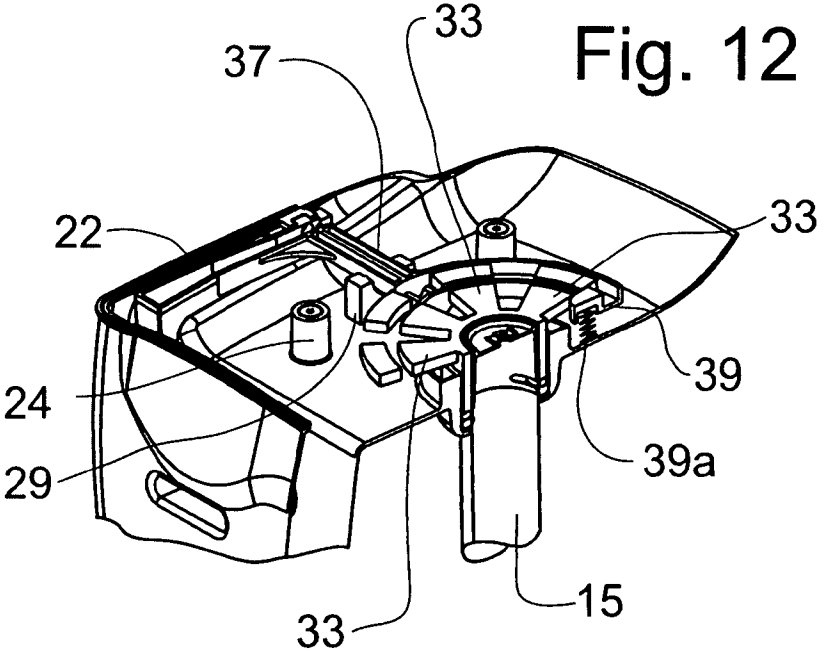
FIG. 12 is a partial cross-sectional view of the high chair seat member shown in FIG. 10 to view the stop member engaged with the toothed gear plate to secure the seat member from further rotation relative to the pedestal and base.
Figure 12A:
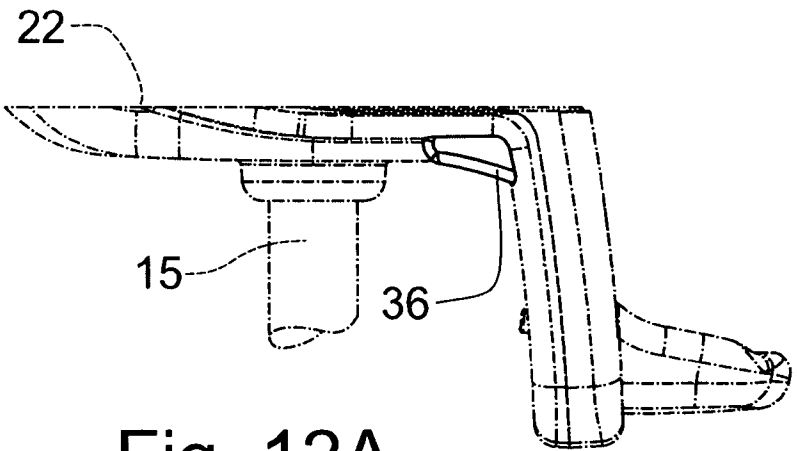
FIG. 12A is a side elevational view of the actuation lever positioned as reflected in FIG. 12 to engage the stop member with the toothed gear plate, the seat structure being shown in phantom.
Figure 11:
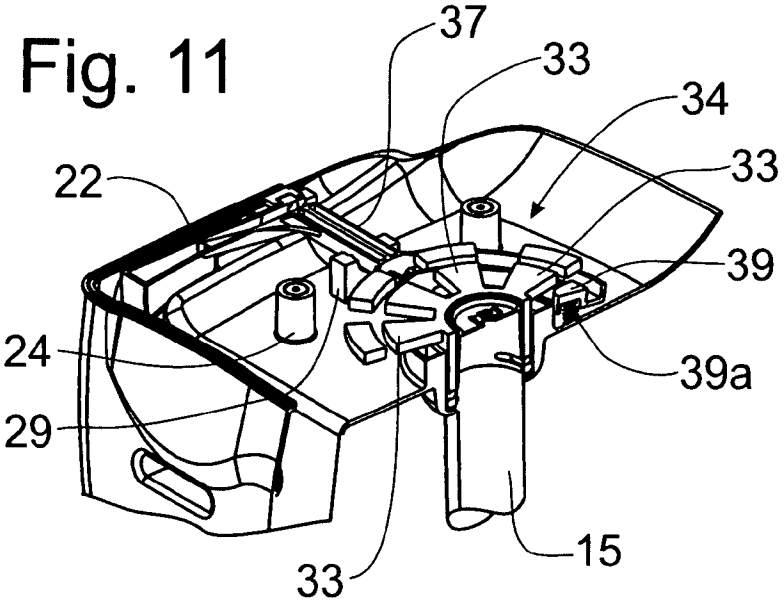
FIG. 11 is a partial cross-sectional view of the high chair seat member shown in FIG. 9 to better view the stop member retracted to allow rotational movement of the seat member relative to the pedestal and base.
Figure 11A:
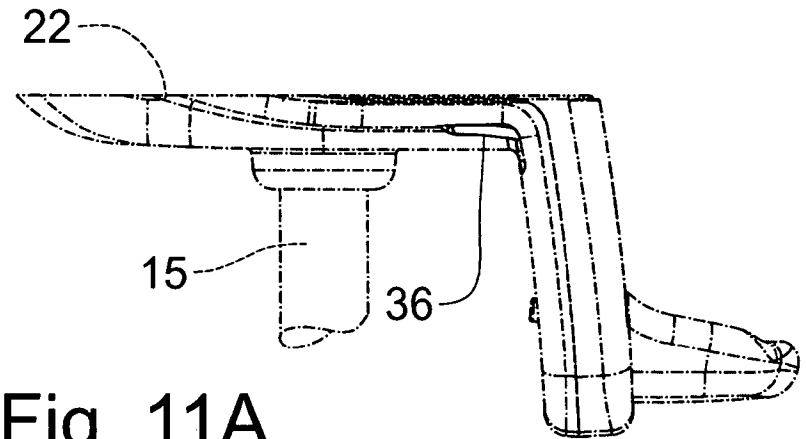
FIG. 11A is a side elevational view of the actuation lever positioned as reflected in FIG. 11 to release the stop member from the toothed gear plate, the seat structure being shown in phantom.
Figure 13:
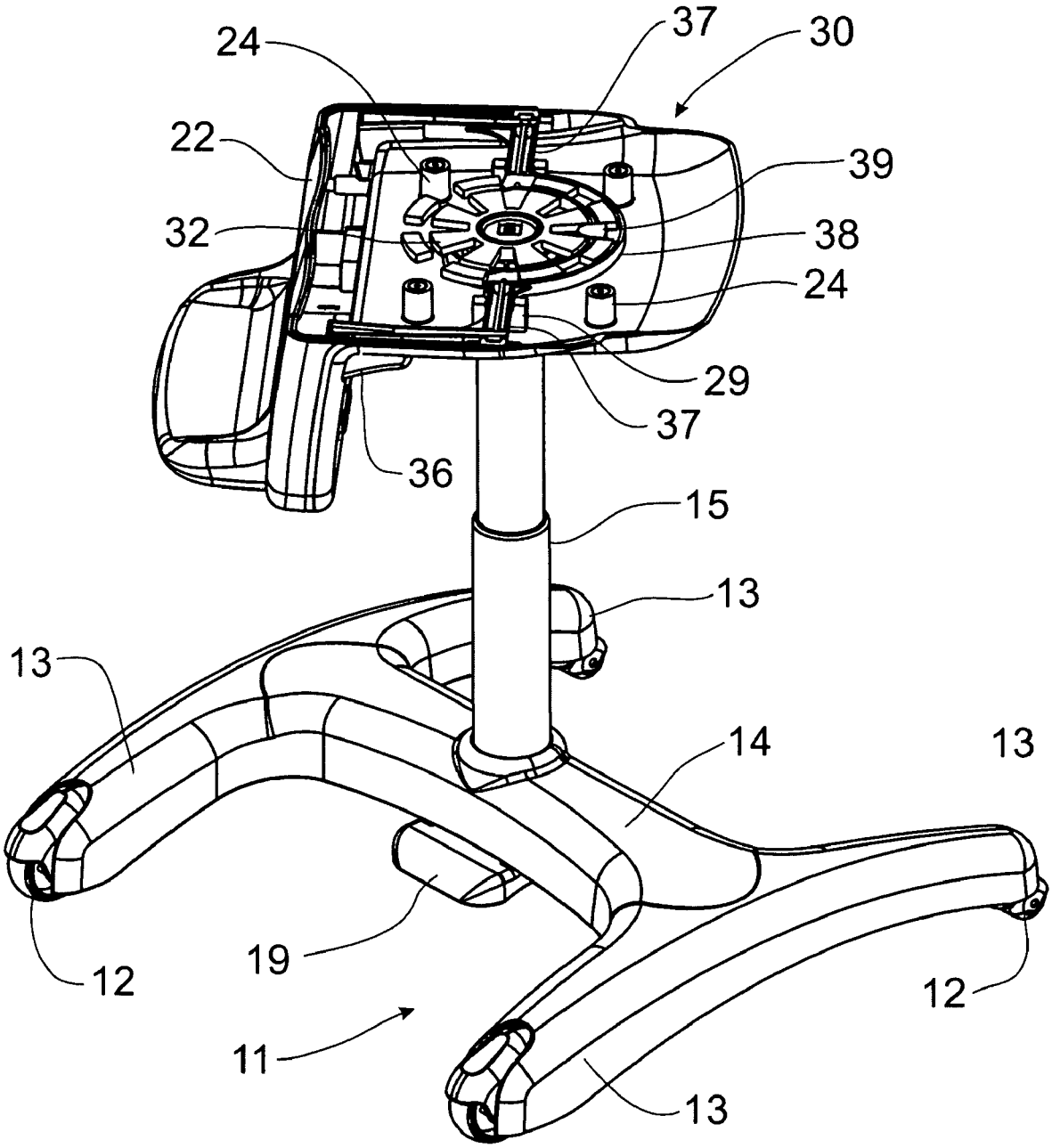
FIG. 13 is a partial front side perspective view of the high chair corresponding to the view of FIG. 2, but having the upper portions of the seat structure removed for purposes of clarity to view the swivel lock mechanism in a locked position.
Figure 15:
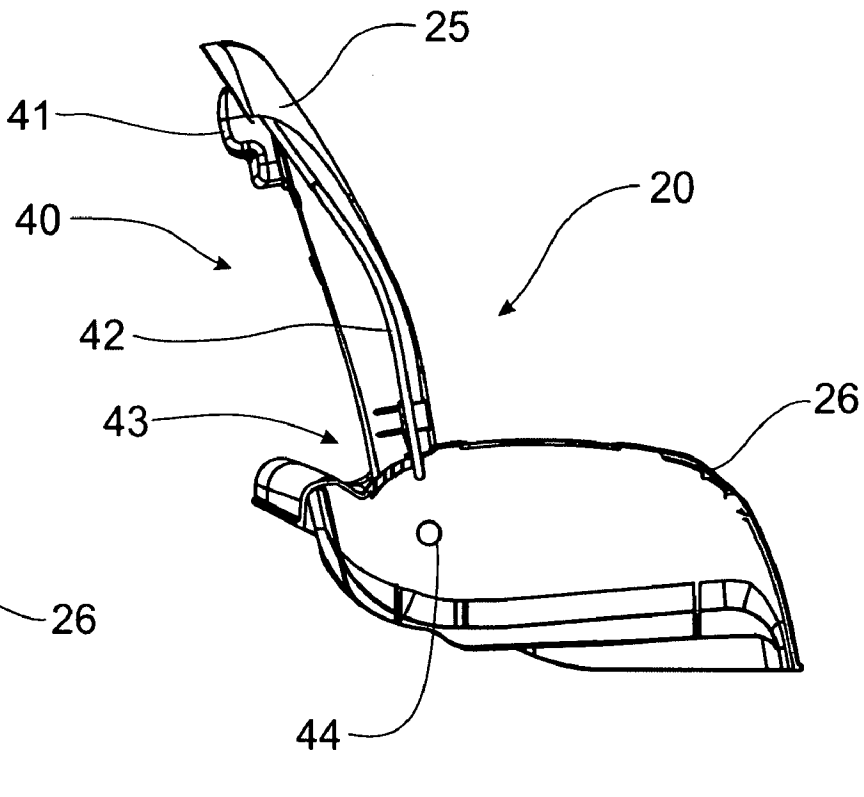
FIG. 15 is a partial cross-sectional view taken through the right arm rest of the seat member to depict the recline latch mechanism for the seat back.
Figure 14:
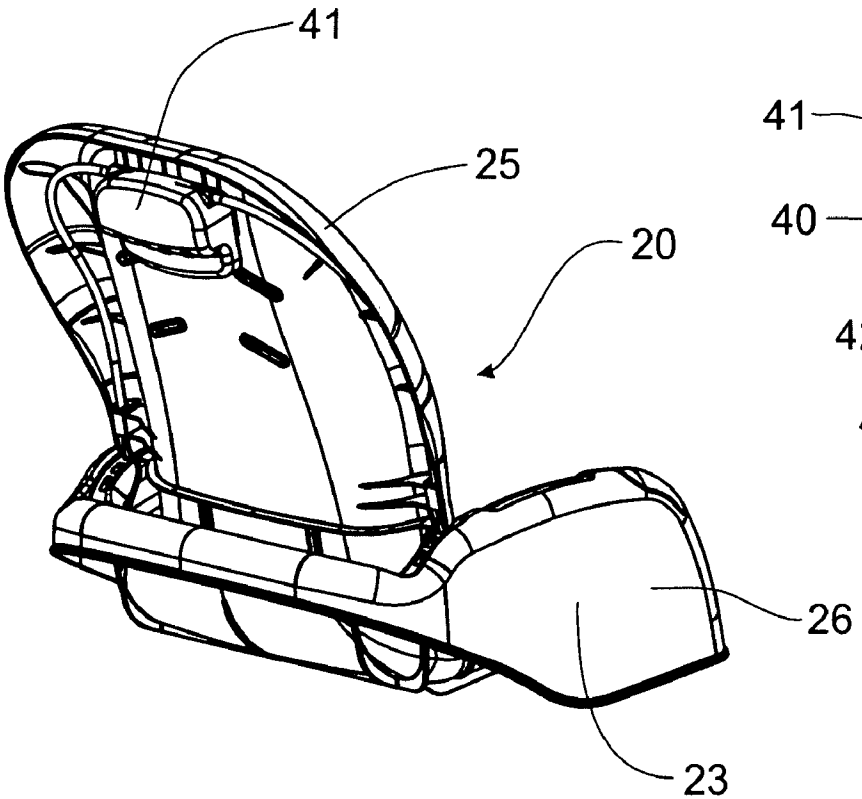
FIG. 14 is a rear perspective view of the seat member.
Figures 16, 17:
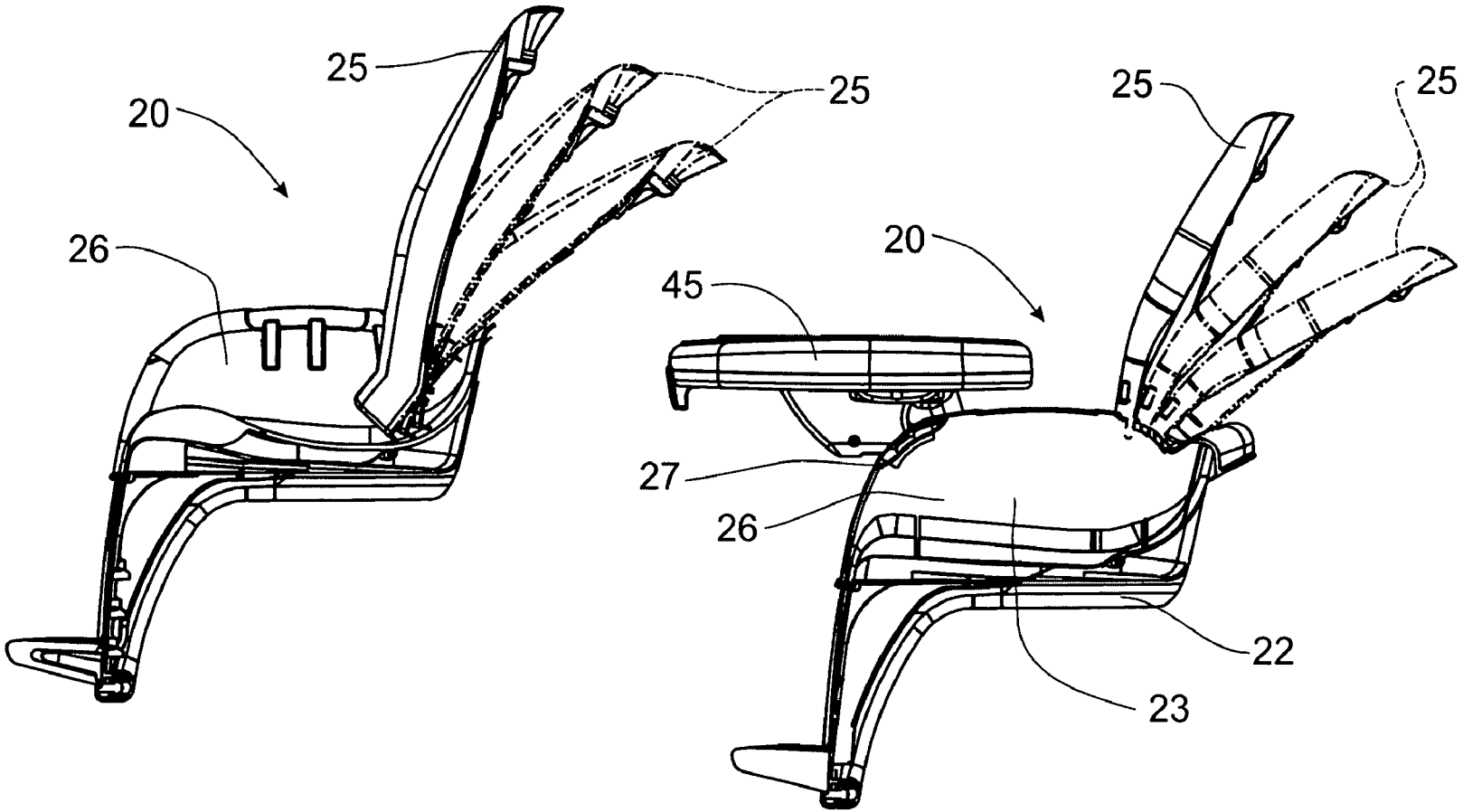
FIG. 16 is a partial cross-sectional view of the high chair taken along the longitudinal centerline of the high chair to show the recline movement of the seat back of the seat member, the two recline positions of the seat back being shown in phantom.
FIG. 17 is a partial left side elevational view of the high chair having a tray mounted thereto, showing the movement of the seat back of the seat member in phantom.

As best seen in FIGS. 2, 6, 11A and 12A, the actuator handles 36 extend out of the base portion 22 through appropriately formed openings therein for access by the caregiver. As depression of the actuator handles 36 into the structure of the base portion 22 causes a pivoting of the actuator member 35 about a transverse pivot axis corresponding to the pivot members 37 and passing through the center of the gear plate 32. The centralized pivot members 37 results in an opposing movement of the arcuate lock member 38 to retract the stop member 39 from engagement with the toothed gear plate 32, as is depicted in FIGS. 11 and 11A. The actuator member 35 is spring-loaded into engagement with the gear plate 32 by a spring 39*a* located for maximum effect under the stop member 39. The stop member 39 retains the spring 39*a* against the base portion 22 so that the retraction of the stop member 39 out of engagement with the gear plate 32 compresses the spring 39*a* to increase the bias force urging the actuator member 35 into a locked position, as depicted in FIG. 12. Accordingly, when the actuator handles are released by the caregiver, the spring 39*a* automatically pivots the actuator member 35 about the pivot members to project the actuator handles 36 back out of the base portion 22 of the seat member 20.

The seat back 25 is preferably formed to be reclined from a vertical orientation throughout a range of reclined positions. As can be seen in FIGS. 14-17, the recline mechanism 40 includes an actuator handle 41 located on the rear side of the seat back 25. The actuator handle 41 is coupled to an elongated locking pin 42 that extends from the actuator handle 41 within the structure of the seat back 25 to engage latch openings 43 formed in the rearward part of the seat portion 23 to lock the seat back 25 in a selected recline position, as shown in phantom and solid lines in FIGS. 16 and 17. To operate, the actuator handle 41 is lifted to disengage the locking pin 42 from the engaged latch opening 43. The seat back 25 is then moved to the desired position about the pivot 44 mounted between the opposing arm rests 26, and the actuator handle 41 can be returned to the latching position to re-engage the locking pin 42 with the corresponding latch opening 43.

The seat member 20 is also provided with receptacles 27 in the arm rests 26 to receive the mounting supports (not shown) of the tray 45. Mounting sleeve (not shown) can be inserted into the receptacles 27 to engage the mounting supports and provide a stronger support than the molded plastic arm rest 26 can provide to resist the forces exerted on the cantilevered tray mechanism 45. Furthermore, the mounting sleeve can be slotted to provide a latch keeper (not shown) for the retention of the tray 45 within the mounting sleeve.

In operation, the high chair 10 incorporates both a swivel feature and a height adjustment feature that are independently operable. The height adjustment feature can be operated through manipulation of the foot pedal 19 that release the gas spring 18 housed within the pedestal 15. By grasping the seat member 20 while depressing the foot pedal 19 to release the gas spring 18, the caregiver can manually position the seat member 20 to the proper height relative to the table or to another adjacent object to properly position a child seated on the seat portion 23 as desired by the caregiver. Lowering the height of the seat member 20 requires an exertion of a downward force on the seat member 20 while the foot pedal 19 is depressed to release the gas cylinder. Raising the seat member 20 can be accomplished by allowing the gas spring 18 to expand, thus telescopically moving the upper portion 17 of the pedestal 15 upwardly with the seat member 20 affixed thereto.

Actuation of the swivel feature is accomplished by depressing the actuation handles 36 into the base portion 22, resulting in a pivoting of the actuation member 35 to move the stop member 39 downwardly out of engagement with the toothed gear plate 32. The seat member 20 is then free to rotate relative to the pedestal 15 in either direction to position the seat member 20 and the child seated thereon as desired by the caregiver. Even though the H-shaped base member 11 has substantial flexibility in positioning the high chair 10 relative to an obstruction, such as a table leg, the resultant positioning of the seat member 20 may not be to the liking of the caregiver. By providing a swivel function through the rotational mounting of the base portion 22 on the pedestal 15, the caregiver can rotate the position of the child to the convenience of the caregiver irrespective of the necessary positioning of the H-shaped base member 11.

Furthermore, the placement of the actuation handles 36 on the underside of the base portion 22 requires the caregiver to grasp at least one side of the seat member 20 while positioning the seat member 20 rotationally. Additionally, a natural and logical pulling up of the actuation handles 36 is required to affect rotation of the seat member. The actuator member 35 can be operated through either side of the base portion 22 by depressing only one of the actuator handles 36 to cause the pivoting of the actuation member 35 that disengages the stop member 39 from the toothed gear plate 32. Although the swivel feature compliments the function of the H-shaped base member 11 to facilitate the positioning of the child on the seat member 20 as desired by the caregiver, the swivel function can be utilized for any high chair irrespective of the configuration of the base member 11, or irrespective of the configuration of the support frame of the high chair that positions the seat member 20 in an elevated position. The pedestal 15 can be formed in a smaller configuration to provide the capability for a swivel feature for substantially any base frame configuration. The novel swivel lock mechanism 30 is housed within the structure of the seat member 20 and can be adapted to work with substantially any support structure for the swivel function.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A high chair comprising:

a base frame;

a seat member supported on said base frame for rotation relative thereto, said seat member including a base portion receiving said base frame and a seat portion mounted above said base portion;

a swivel lock mechanism supported within said seat member to selectively control the rotation of the seat member relative to said base frame, said swivel lock mechanism including a first member connected to said base frame and an actuator member pivotally carried by said seat member for movement about a generally horizontal pivot axis oriented centrally through said first member to be selectively engagable with said first member to prevent movement of said first member, both said first member and said actuator member being positioned between said base portion and said seat portion of said seat member, said actuator member being pivotally movable between a locked position in which said first member is engaged and an unlocked position in which said first member is disengaged from said actuator member.

2. The high chair of claim 1 further comprising a height adjustment mechanism supported by said base frame to move said seat member vertically relative to said base frame.

3. The high chair of claim 2 wherein said base frame has a base member formed in a configuration that includes four legs projecting outwardly from a central member, each said leg including a wheel to mobilize said base frame.

4. The high chair of claim 3 wherein a pedestal extends vertically from said central member.

5. The high chair of claim 4 wherein said height adjustment mechanism includes a gas spring housed within said pedestal, the operation of said gas spring being controlled by a foot pedal supported on said transverse member.

6. The high chair of claim 1 wherein said first member is a gear plate affixed to said base frame and defining notches therein; and said actuator member has a stop member selectively engagable with a selective one of said notches in said gear plate, said stop member being engaged with one of said notches when said actuator member is in said locked position, said stop member being disengaged from said gear plate when said actuator member is in said unlocked position to control the rotation of said seat member.

7. The high chair of claim 6 wherein said actuator member includes an actuator handle projecting out of said seat member for pivotal manipulation of said actuator member.

8. The high chair of claim 7 wherein said stop member and said actuator handle are on opposing sides of axis of said actuator member such that a retraction of said actuator handle into said seat member will cause said actuator member to move into said unlock position.

9. The high chair of claim 8 wherein said actuator member includes a pair of actuator handles located, respectively, on opposing sides of said seat member, manipulation of either of said actuation handles being operable to move said actuator member into said unlocked position.

10. The high chair of claim 9 wherein said gear plate is circular with radially extending teeth oriented in a plane and defining said notches therebetween, said actuator member including an arcuate portion positioned concentrically to said gear plate and having said stop member formed thereon.

11. The high chair of claim 7 wherein said actuator member is spring-biased toward said locked position.

12. A juvenile chair comprising:

a base frame having a plurality of generally horizontally extending legs defining unobstructed peripheral portions of said base frame to permit said base frame to be positioned relative to an obstruction with one of said legs being on opposing sides of said obstruction, said base frame including an upright portion;

a seat member supported on said upright portion for rotation relative to said base frame;

a swivel lock mechanism supported within said seat member to selectively control the rotation of the seat member relative to said base frame, said swivel lock mechanism including a gear plate affixed to said upright portion and being located internally of said seat member and an actuator member pivotally carried by said seat member to define a generally horizontal pivot axis extending centrally through said gear plate, said gear plate defining notches therein oriented for engagement with a stop member formed on said actuator to control rotation of said seat member, said actuator member including an actuator handle projecting out of said seat member for pivotal manipulation of said actuator member to control the engagement of said stop member with said notches in said gear plate.

13. The juvenile chair of claim 12 wherein said legs project outwardly from a central member, said upright portion including a pedestal extending vertically from said central member.

14. The juvenile chair of claim 13 further comprising a height adjustment mechanism support by said base frame to move said seat member vertically relative to said base frame, said height adjustment mechanism including a gas spring housed within said pedestal, the operation of said gas spring being controlled by a foot pedal support on said transverse member.

15. The juvenile chair of claim 12 wherein said actuator member is movable between a locked position in which said stop member is engaged with a selected one of said notches and an unlocked position in which said stop member is disengaged from said gear plate thereby controlling the rotation of said seat member.

16. The high chair of claim 15 wherein said actuator member includes:

transversely extending pivot members defining said pivot axis passing centrally through said gear plate;

a pair of actuator handles extending, respectively, on one side of said pivot members and projecting out of said seat member for pivotal manipulation of said actuator member; and an arcuate portion extending on an opposing side of said pivot members from said actuator handles, said arcuate portion being oriented concentrically with said gear plate, said stop member being formed on said arcuate portion to engage said notches.

17. The juvenile chair of claim 16 wherein said actuator member is spring-biased toward said locked position.

18. A juvenile high chair comprising:

a base frame including a central member having a plurality of generally horizontally extending legs with unobstructed peripheral portions between adjacent legs of said base frame to permit said base frame to be positioned relative to an obstruction with said legs being on opposing sides of said obstruction, said base frame including an upright portion having an upright pedestal extending vertically from said central member;

a seat member having a seat back and being supported on said pedestal for rotation relative to said base frame, said seat member including a recline mechanism to permit said seat back to be reclined relative to said seat member;

a swivel lock mechanism supported within said seat member to selectively control the rotation of the seat member relative to said base frame, said swivel lock mechanism having a first member mounted on said upright portion and positioned internally of said seat member, said swivel lock mechanism further having an actuator member carried by said seat member and being selectively engagable with said first member to control rotation of said seat member, said actuator member including transversely extending pivot members located on opposing sides of said first member and defining a generally horizontal pivot axis passing centrally through said first member, and a pair of actuator handles extending on respective first sides of said pivot members and projecting out of said seat member for manipulation of said actuator member.

19. The juvenile high chair of claim 18 wherein said first member is a gear plate affixed to said pedestal and defining notches therein; and said actuator member having a stop member selectively engagable with a selective one of said notches in said gear plate, said actuator member being movable between a locked position in which said stop member is engaged with one of said notches to prevent relative movement between said seat member and said pedestal, and an unlocked position in which said stop member is disengaged from said gear plate to allow rotational movement of said seat member.

20. The high chair of claim 19 wherein said actuator member includes:

an arcuate portion extending on an opposing side of said pivot members from said actuator handles, said arcuate portion being oriented concentrically with said gear plate, said stop member being formed on said arcuate portion to engage said notches; and a spring biasing said stop member toward said locked position so that the depression of one of said actuation handles into said seat member being operable to overcome said spring to allow said stop member to disengage said gear plate, said stop member being re-engaged with said gear plate upon a release of said actuator handles.

* * * * *